US010354627B2

(12) United States Patent
Ogasawara

(10) Patent No.: US 10,354,627 B2
(45) Date of Patent: Jul. 16, 2019

(54) SINGING VOICE EDIT ASSISTANT METHOD AND SINGING VOICE EDIT ASSISTANT DEVICE

(71) Applicant: YAMAHA CORPORATION, Hamamatsu-shi (JP)

(72) Inventor: Motoki Ogasawara, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/145,661

(22) Filed: Sep. 28, 2018

(65) Prior Publication Data

US 2019/0103082 A1 Apr. 4, 2019

(30) Foreign Application Priority Data

Sep. 29, 2017 (JP) ..... 2017-191630

(51) Int. Cl.
*G10H 7/00* (2006.01)
*G10H 1/00* (2006.01)

(52) U.S. Cl.
CPC ..... *G10H 1/0008* (2013.01); *G10H 7/008* (2013.01); *G10H 2210/331* (2013.01); *G10H 2220/116* (2013.01)

(58) Field of Classification Search
CPC ..... G10H 1/0008; G10H 7/008; G10H 2220/116; G10H 2210/331; G10H 2250/455
USPC ..... 84/604
See application file for complete search history.

(56) References Cited

U.S. PATENT DOCUMENTS 8,907,195 B1 12/2014 Erol
2011/0149594 A1 6/2011 Terajima et al.
2012/0031257 A1* 2/2012 Saino ..... G10H 1/0058 84/622
2013/0112062 A1* 5/2013 Iriyama ..... G10H 1/0008 84/453
2014/0136207 A1* 5/2014 Kayama ..... G10L 13/08 704/258
2014/0278433 A1* 9/2014 Iriyama ..... G10L 13/02 704/261

(Continued)

FOREIGN PATENT DOCUMENTS

EP 2610859 A2 7/2013
EP 2779159 A1 9/2014

(Continued)

OTHER PUBLICATIONS

Extended European Search Report issued in European Appln. No. 18197462.7 dated Feb. 26, 2019.

*Primary Examiner* — Jeffrey Donels
(74) *Attorney, Agent, or Firm* — Rossi, Kimms & McDowell LLP

(57) ABSTRACT

A singing voice edit assistant method includes: displaying singing waveforms represented by singing waveform data calculated based on score data representing a time series of notes and lyrics data representing words on a display device, on a note-by-note basis on a two-dimensional waveform screen having a pitch axis and a time axis, each singing waveform being displayed at a position located by a pitch and timing of a note corresponding to the singing waveform; and displaying a phoneme of each word at a pronunciation timing of the phoneme on the waveform screen.

14 Claims, 10 Drawing Sheets

(56) References Cited

U.S. PATENT DOCUMENTS

| | | | | |
|---|---|---|---|---|
| 2015/0040743 | A1* | 2/2015 | Tachibana | G10H 1/361 84/622 |
| 2015/0310850 | A1* | 10/2015 | Nakano | G10L 13/10 704/258 |
| 2016/0133246 | A1* | 5/2016 | Ogasawara | G10L 13/033 704/260 |
| 2018/0166064 | A1* | 6/2018 | Saino | G10L 13/00 |
| 2018/0268792 | A1* | 9/2018 | Serletic | G10L 13/08 |

FOREIGN PATENT DOCUMENTS

| | | | |
|---|---|---|---|
| JP | 2011211085 | A | 10/2011 |
| WO | 2017033612 | A1 | 3/2017 |

* cited by examiner

FIG. 1

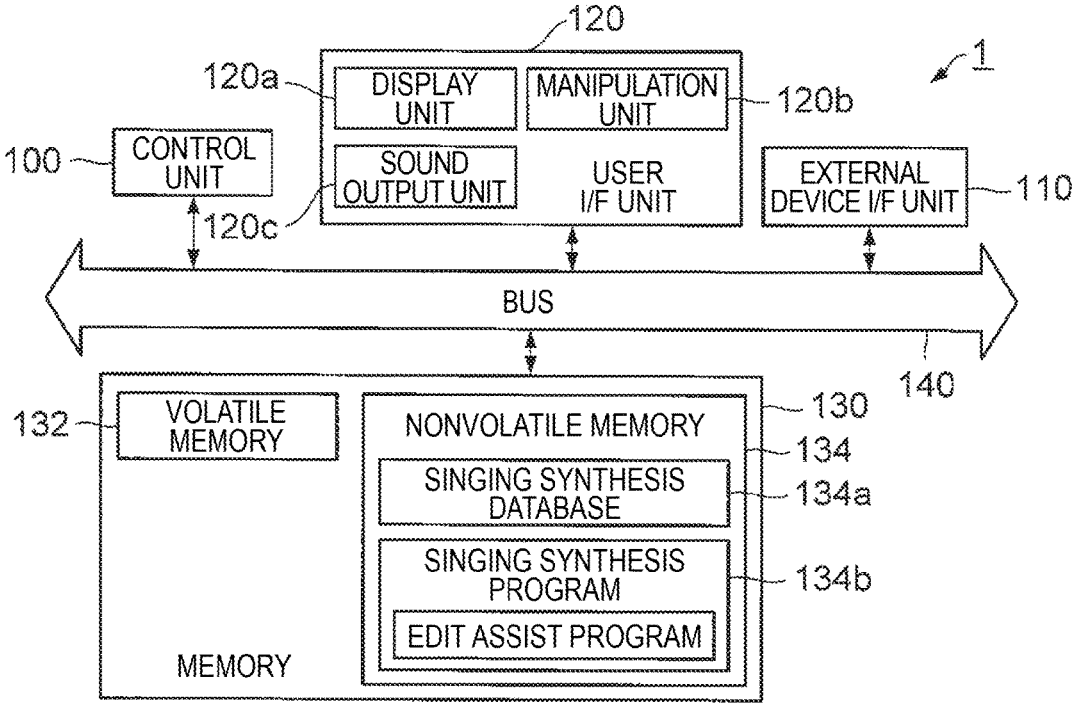

FIG. 2

IND

| | 1ST NOTE | 2ND NOTE | 3RD NOTE | |
|---|---|---|---|---|
| START/END TIME | 00:01 ~ 00:03 | 00:03 ~ 00:05 | 00:05 ~ 00:07 | |
| WORD | I | love | you | |
| PHONETIC SYMBOLS | aI | 10Vv | ju: | .. |
| PITCH | C3 | D3 | E3 | |
| PARAMETERS FOR ADDING VARIOUS FEATURES | OPTIONAL | OPTIONAL | OPTIONAL | |

SINGING SYNTHESIZING ENGINE

OUTD

| | 1ST FRAME | 2ND FRAME | | nTH FRAME | (n + 1)TH FRAME | | mTH FRAME | (m + 1)TH FRAME | |
|---|---|---|---|---|---|---|---|---|---|
| SINGING WAVEFORM DATA | DATA | DATA | | DATA | DATA | | DATA | DATA | |
| PITCH CURVE DATA | DATA | DATA | .. | DATA | DATA | .. | DATA | DATA | .. |
| PHONETIC SYMBOLS | aI | aI | | IO | IO | | V | V | |

SINGING VOICE EDIT ASSISTANT METHOD AND SINGING VOICE EDIT ASSISTANT DEVICE

CROSS REFERENCE TO RELATED APPLICATIONS

This application is based on Japanese Patent Application (No. 2017-191630) filed on Sep. 29, 2017, the contents of which are incorporated herein by reference.

BACKGROUND OF THE INVENTION

1. Field of the Invention

The present invention relates to a technique for assisting a user to edit a singing voice.

2. Description of the Related Art

In recent years, a singing synthesizing technology for synthesizing a singing voice electrically has come to be used broadly. In the conventional singing synthesizing technology, it is a general procedure to input notes that constitute a melody of a song and words that are pronounced in synchronism with the respective notes using a screen that is in piano roll form (refer to JP-A-2011-211085).

In an actual singing voice, there may occur a case that the start timing of a note is not coincide with the start timing of a word voice corresponding to the note. However, the technique disclosed in Patent document 1 has a problem that a deviation between the start timing of the note and the start timing of the voice corresponding to the note cannot be confirmed by the user and hence it is difficult to edit a start portion of the voice corresponding to the note.

SUMMARY OF THE INVENTION

The present invention has been made in view of the above problem, and an object of the invention is therefore to provide a technique that makes it possible to edit, easily, a voice reproduction start portion of a word corresponding to a note in synthesis of a singing voice.

To solve the above problem, one aspect of the invention provides a singing voice edit assistant method including:

displaying singing waveforms represented by singing waveform data calculated based on score data representing a time series of notes and lyrics data representing words on a display device, on a note-by-note basis on a two-dimensional waveform screen having a pitch axis and a time axis, each singing waveform being displayed at a position located by a pitch and timing of a note corresponding to the singing waveform; and displaying a phoneme of each word at a pronunciation timing of the phoneme on the waveform screen.

Further aspects of the invention provide a program for causing a computer to execute the above-described singing waveform display process and phoneme display process and a program for causing a computer to function. As for the specific manner of providing these programs, a mode that they are delivered by downloading over a communication network such as the Internet and a mode that they are delivered being written to a computer-readable recording medium such as a CD-ROM (compact disc-read only memory) are conceivable.

BRIEF DESCRIPTION OF THE DRAWINGS

FIG. 1 is a block diagram showing an example configuration of a singing synthesizer 1 which performs an edit assistant method according to an embodiment of the present invention.

FIG. 2 is a table showing structures of singing synthesis input data and singing synthesis output data.

DETAILED DESCRIPTION OF THE EXEMPLARY EMBODIMENTS

Figure 3:
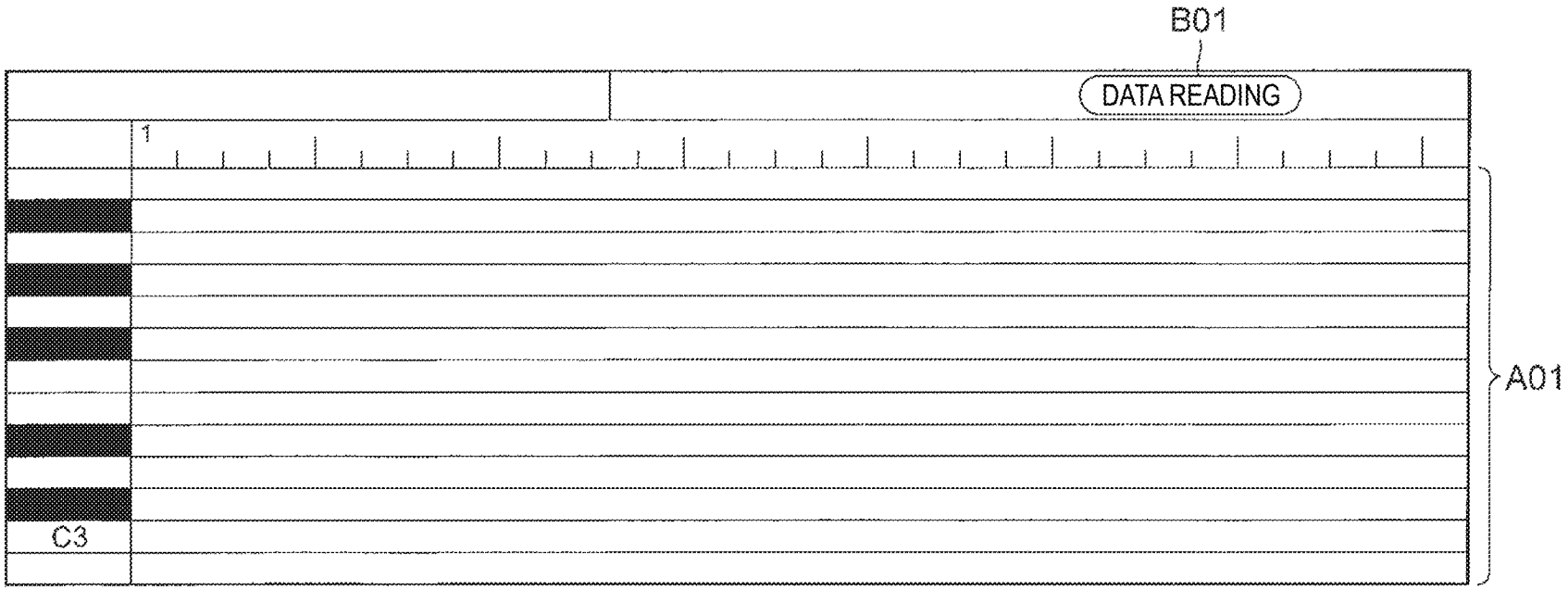
FIG. 3 shows an example score edit screen that the control unit 100 operating according to an edit assist program causes a display unit 120*a* to display.

An embodiment of the present invention will be hereinafter described with reference to the drawings.

FIG. 1 is a block diagram showing an example configuration of a singing synthesizer 1 according to the embodiment of the invention. The singing synthesizer 1 is a personal computer, for example, and a singing synthesis database 134*a* and a singing synthesis program 134*b* are installed therein in advance. As shown in FIG. 1, the singing synthesizer 1 is equipped with a control unit 100, an external device interface unit 110, a user interface unit 120, a memory 130, and a bus 140 for data exchange between the above constituent elements. In FIG. 1, the external device interface unit 110 is abbreviated as an external device I/F unit 110 and the user interface unit 120 is abbreviated as a user I/F unit 120. The same abbreviations will be used below in the specification. Although in the embodiment the computer in which the singing synthesis database 134*a* and the singing synthesis program 134*b* are installed is a personal computer, they may be installed in a portable information terminal such as a tablet terminal, a smartphone, or a PDA or a portable or stationary home game machine.

The control unit 100 is a CPU (central processing unit). The control unit 100 functions as a control nucleus of the singing synthesizer 1 by running the singing synthesis program 134*b* stored in the memory 130.

Although not shown in detail in FIG. 1, the external device I/F unit 110 includes a communication interface and a USB (universal serial bus) interface. The external device I/F unit 110 exchanges data with an external device such as another computer. More specifically, a USB memory or the like is connected to the USB interface and data is read out from the USB memory under the control of the control unit 100 and transferred to the control unit 100. The communication interface is connected to a communication network such as the Internet by wire or wirelessly. The communication interface transfers, to the control unit 100, data received from the communication network under the control of the control unit 100. The external device I/F unit 110 is used in installing the singing synthesis database 134*a* and the singing synthesis program 134*b*.

The user I/F unit 120 is equipped with a display unit 120*a*, a manipulation unit 120*b*, and a sound output unit 120*c*. For example, the display unit 120*a* consists of a liquid crystal display and its drive circuit. The display unit 120*a* displays various screens under the control of the control unit 100. Example screen displayed on the display unit 120*a* various screens for assisting an edit of a singing voice.

The manipulation unit 120*b* includes a pointing device such as a mouse and a keyboard. If the user performs a certain manipulation on the manipulation unit 120*b*, the manipulation unit 120*b* gives data indicating the manipulation to the control unit 100, whereby the manipulation of the user is transferred to the control unit 100. Where the singing synthesizer 1 is constructed by installing the singing synthesis program 134*b* in a portable information terminal, it is appropriate to use its touch panel as the manipulation unit 120*b*.

The sound output unit 120*c* includes a D/A converter for D/A-converting waveform data supplied from the control unit 100 and outputs a resulting analog sound signal and a speaker for outputting a sound according to the analog sound signal that is output from the D/A converter. The sound output unit 120*c* is used in reproducing a synthesized singing voice.

As shown in FIG. 1, the memory 130 includes a volatile memory 132 and a non-volatile memory 134. The volatile memory 132 is a RAM (random access memory), for example. The volatile memory 132 is used as a work area by the control unit 100 in running a program. The non-volatile memory 134 is a hard disk drive, for example. The singing synthesis database 134*a* is stored in the non-volatile memory 134. The singing synthesis database 134*a* contains voice element data that are waveform data of voice elements of a wide variety of voice elements that are different from each other in the tone of voice or phoneme in such a manner that the voice element data are classified by the tone of voice. The singing synthesis program 134*b* as well as the singing synthesis database 134*a* is stored in the non-volatile memory 134. Although not shown in detail in FIG. 1, a kernel program for realizing an OS (operating system) in the control unit 100 is stored in the non-volatile memory 134.

The control unit 100 reads out the kernel program from the non-volatile memory 134 triggered by power-on of the singing synthesizer 1 and starts execution of it. A power source of the singing synthesizer 1 is not shown in FIG. 1. The control unit 100 in which the OS is realized by the kernel program reads a program whose execution has been commanded by a manipulation on the manipulation unit 120*b* from the non-volatile memory 134 into the volatile memory 132 and starts execution of it. For example, when instructed to run the singing synthesis program 134*b* by a manipulation on the manipulation unit 120*b*, the control unit 100 reads the singing synthesis program 134*b* from the non-volatile memory 134 into the volatile memory 132 and starts execution of it. A specific example of the manipulation for commanding execution of a program is mouse clicking on an icon displayed on the display unit 120*a* as an item corresponding to the program or tapping of it.

When operating according to the singing synthesis program 134*b*, the control unit 100 functions as a singing synthesizing engine which generates singing synthesis output data on the basis of score data representing a time series of notes corresponding to a melody of a song as a target of synthesis of a singing voice and lyrics data representing words that are pronounced in synchronism with the respective notes and writes the generated singing synthesis output data to the non-volatile memory 134.

The singing synthesis output data is waveform data (e.g., audio data in the way format) representing a sound waveform of a singing voice synthesized the basis of score data and lyrics data and, more specifically, a sample sequence obtained by sampling the sound waveform. In the embodiment, the score data and the lyrics data are stored in the singing synthesizer 1 as singing synthesis input data that is their unified combination. Singing synthesis output data generated on the basis of the singing synthesis input data is stored so as to be correlated with it.

FIG. 2 is a table showing a relationship between singing synthesis input data IND and singing synthesis output data OUTD generated on the basis of it. For example, the singing synthesis input data IND is data that complies with the SMF (Standard MIDI File) format, that is, data that prescribes events of notes to be pronounced in order of pronunciation. As shown in FIG. 2, the singing synthesis input data IND is arrangements, in order of pronunciation of the notes that constitutes a melody of a song as a target of synthesis of a singing voice, of data indicating start and end timings of the notes, pitch data indicating pitches of the respective notes, lyrics data representing words to be pronounced in synchronism with the respective notes, and parameters for adjustment of intrinsic singing features of a singing voice.

The data indicating start and end timings of the notes and pitch data indicating pitches of the respective notes serve as score data (mentioned above). A specific example of the adjustment of intrinsic singing features of a singing voice is performing an edit relating to the manner of variation of the sound volume, the manner of variation of the pitch, or the length of pronunciation of a word so as to produce a natural singing voice as sung by a human. Specific examples of the parameters for adjustment of intrinsic singing features of a singing voice are parameters indicating at least one of the sound volume, pitch, and duration of each of the notes represented by the score data, the timing and the number of times of breathing, and breathing strengths, data for specifying a timbre (tone of voice) of a singing voice, data prescribing the lengths of consonants of words to be pronounced in synchronism with the notes, and data indicating durations and amplitudes of vibratos. In the embodiment, as in the conventional singing synthesis techniques, data of notes of SMF are given a role of data prescribing the lengths of consonants of words to be pronounced in synchronism with the notes.

In the embodiment, text data representing character strings constituting words to be pronounced in synchronism with notes and phonetic symbol data indicating phonemes of the words are used as the lyrics data representing the words. Alternatively, only the text data or only the phonetic symbol data may be used as the lyrics data. However, where only the text data is used as the lyrics data, it is necessary that the singing synthesis program 134*b* be provided with a mechanism for generating phonetic symbol data from the text data. That is, in the invention, the lyrics data of the singing synthesis input data may have any contents or of any form as long as it is data representing phonetic symbols of words or data capable of specifying phonetic symbols.

As shown in FIG. 2, the singing synthesis output data OUTD which is generated by the singing synthesizing engine and written to the non-volatile memory 134 is arrangements of singing waveform data indicating singing voice waveforms in respective time frames of a singing voice, pitch curve data indicating temporal pitch variations in the respective frames, and phonetic symbol data representing phonemes of words in the respective frames. The term "time frame" means a sampling period of each sample in each sample sequence constituting the singing waveform data. Data, in each frame, of the singing waveform data or the pitch curve data means a sampled value of a singing waveform or a sampled value of a pitch curve in a sampling period.

The singing waveform data contained in the singing synthesis output data OUTD is generated by reading out, from the singing synthesis database 134*a*, voice element data corresponding to phonemes of the words to be pronounced in synchronism with the respective notes of the singing synthesis input data IND, converting them to pitches of the respective notes, and connecting resulting voice element data together.

The singing synthesis program 134*b* includes an edit assist program for assisting an edit of a singing voice. When execution of the singing synthesis program 134*b* is commanded by a manipulation on the manipulation unit 120*b*, first the control unit 100 runs the edit assist program. When operating according to the edit assist program, the control unit 100 causes the display unit 120*a* to display a score edit screen in piano roll form in the same manners as in the conventional singing synthesis techniques and thereby assists input of words and input of notes. In addition, the edit assist program according to the embodiment is formed so as to be able to display singing waveforms in response to a user instruction to facilitate an edit of a voice reproduction start portion of a word corresponding to each note; this is one feature of the embodiment.

In the following, how an edit assistant method is performed according to the edit assist program will be described for an example case that singing synthesis input data IND and singing synthesis output data OUTD generated on the basis of it are already stored in the non-volatile memory 134.

After starting to run the edit assist program, first, the control unit 100 causes the display unit 120*a* to display a score edit screen shown in FIG. 3. The score edit screen is a picture that presents pitch events in the form of figures in presenting data of a musical piece and thereby enables an edit of data that prescribes pitch events through manipulations on the figures. As shown in FIG. 3, the score edit screen is provided with a piano-roll-form edit area A01 in which one axis represents the pitch and the other axis represents time, as well as a data reading button B01. The piano roll form is a display form in which the vertical axis represents the pitch and the horizontal axis represents time. The data reading button B01 is a virtual manipulator that can be manipulated by mouse clicking or the like. As shown in FIG. 3, immediately after a start of execution of the edit assist program, neither notes nor words to be pronounced in synchronism with respective notes are displayed in the edit area A01 displayed on the display unit 120*a*.

Visually recognizing the score edit screen shown in FIG. 3, by manipulating the manipulation unit 120*b*, a user can input notes to constitute a melody of a singing voice to be synthesized and words to be pronounced in synchronism with the respective notes. By clicking the data reading button B01 as a manipulation on the manipulation unit 120*b*, the user can make an instruction to read already generated singing synthesis input data as an edit target. When the data reading button B01 is clicked, the control unit 100 causes the display unit 120*a* to display a list of pieces of information (e.g., character strings representing file names) indicating singing synthesis input data stored in the non-volatile memory 134. The user can designate edit target singing synthesis input data by performing a selection manipulation on the list.

When edit target singing synthesis input data is designated in the above-described manner, the control unit 100 changes the display of the score edit screen by reading the singing synthesis input data designated by the user from the non-volatile memory 134 into the volatile memory 132 and arranging, in the edit area A01, individual figures indicating respective notes (e.g., figures indicating pitch events), character strings representing words to be pronounced in synchronism with the respective notes, and phonetic symbols representing phonemes of the words, respectively, on a note-by-note basis according to the singing synthesis input data. The term "individual figure" means a figure that is defined by a closed outline. In the following, an individual figure indicating a note will be referred to as a "note block." For example, when the above-described singing synthesis input data IND is designated as an edit target, the display of the score edit screen are changed as shown in FIG. 4 accordingly.

Figure 4:
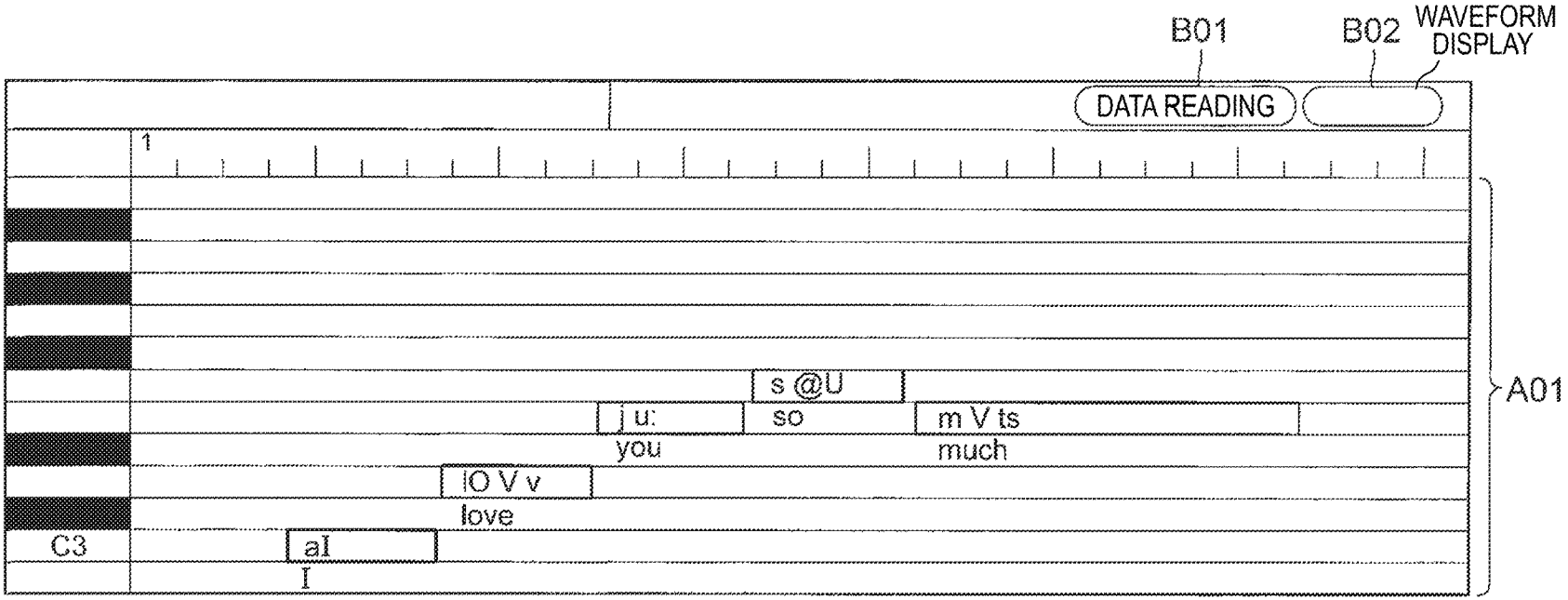
FIG. 4 shows an example score edit screen that is displayed after designation of edit target singing synthesis input data.

As shown in FIG. 4, in the embodiment, each note block is a rectangle defined by a solid-line outline. The control unit 100 disposes, for each note, a rectangle extending from a start timing and an end timing indicated by the singing synthesis input data at a position, corresponding to a pitch of the note, in the pitch axis direction. The control unit 100 disposes phonetic symbols representing a phoneme of a word corresponding to the note in the associated note block at a position adjacent to the line corresponding to the pronunciation start timing of the note, and disposes a character string of a word corresponding to the note under and in the vicinity of the rectangle. That is, on the score edit screen shown in FIG. 4, the pronunciation start timing point of a phoneme of a word corresponding to each note is not correlated with the display position of a phonetic symbol indicating a pronunciation of the phoneme. This is because it suffices to recognize, for each note block, a phoneme to be pronounced.

It is not always the case that one phoneme is correlated with each note; plural phonemes may be correlated with one note. Where plural phonemes are correlated with one note, the control unit 100 arranges phonetic symbols representing pronunciations of the plural respective phonemes inside the note block in order they are pronounced.

As seen from comparison between FIGS. 3 and 4, upon completion of reading of the edit target singing synthesis input data, a waveform display button B02 is displayed on the score edit screen in addition to the data reading button B01. The waveform display button B02 is a virtual manipulator, like the data reading button B01. Although in the embodiment the waveform display button B02 is not displayed before completion of reading of edit target singing synthesis input data and is displayed triggered by completion of reading of the edit target singing synthesis input data, the waveform display button B02 may be displayed all the time.

Figure 5:
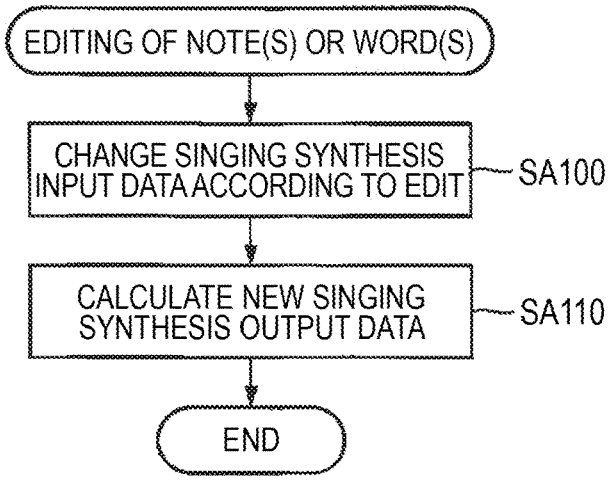
FIG. 5 is a flowchart of a change process which is executed by the control unit 100 according to the edit assist program.

The user of the singing synthesizer 1 can edit each note by changing the length or position in the time axis direction or the position in the pitch axis direction of the rectangle corresponding to the note, and can edit the word to be pronounced in synchronism with the note by rewriting a character string representing the word. When operating according to the edit assist program, the control unit 100 executes a change process shown in FIG. 5 triggered by editing of a note(s) or a word(s).

In the editing process, at step SA100, the control unit 100 changes the edit target singing synthesis input data according to the editing performed on the edit area A01. At step S110, the control unit 100 changes, through calculation, the singing synthesis output data that is generated on the basis of the edit target singing synthesis input data (and is stored so as to be correlated with the latter). At step S110, the control unit 100 calculates only singing waveform data corresponding to the edited note or word.

The user can switch the display screen of the display unit 120*a* to a waveform screen by clicking the waveform display button B02. Triggered by clicking of the waveform display button B02, the control unit 100 switch the display screen of the display unit 120*a* to the waveform screen and executes a waveform display process shown in FIG. 6. Like the score edit screen, the waveform screen has a piano-roll-form edit area A02 one axis represents the pitch and the other axis represents time (see FIG. 7). Among the singing waveforms represented by the singing waveform data contained in the singing synthesis output data, singing waveforms in the interval in which the note blocks etc. have been displayed in the edit area A01 of the score edit screen before the switching to the waveform screen are displayed in the edit area A02 of the waveform screen. That is, the waveform screen employed in the embodiment is a picture in which information of a musical piece is presented in such a manner that data of the musical piece are presented by displaying sound waveforms of the musical piece and can be edited by manipulating the sound waveforms.

Figure 6:
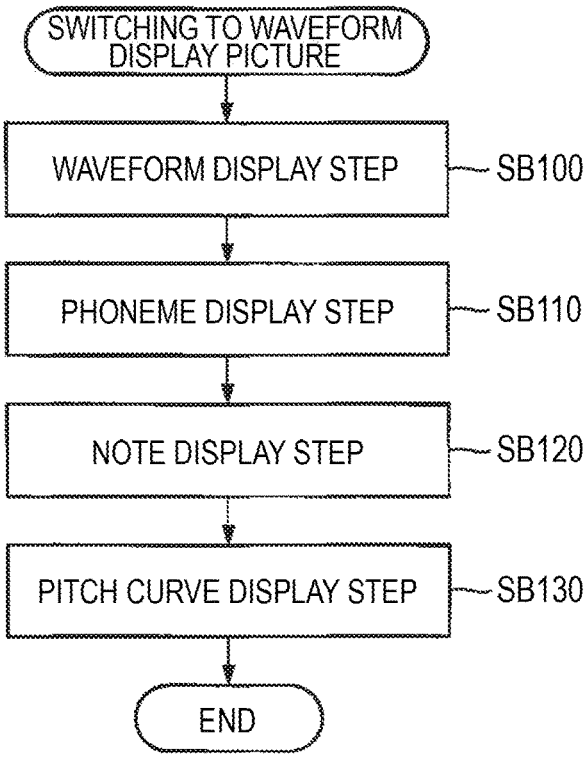
FIG. 6 is a flowchart of a waveform display process which is executed by the control unit 100 according to the edit assist program.

Referring to FIG. 6, at a waveform display step SB100 of the waveform display process, the control unit 100 displays, in the edit area A02, in sections corresponding to respective notes, waveforms in the interval in which the note blocks etc. have been displayed in the edit area A01 of the score edit screen before the switching to the waveform screen among the singing voice waveforms represented by the singing waveform data contained in the singing synthesis output data corresponding to the edit target singing synthesis input data, that is, the singing synthesis output data synthesized on the basis of the edit target singing synthesis input data.

In general, there are two kinds of display forms of singing voice waveforms, that is, a display form (hereinafter referred to as a "singing waveform form") in which singing voice waveforms themselves (i.e., oscillation waveforms representing temporal amplitude oscillations of a singing voice) are displayed and a display form (hereinafter referred to as an "envelope form") in which envelopes of vibration waveforms are displayed. The embodiment employs the envelope form.

At the display step SB100, the control unit 100 determines, for each of singing waveform data contained in the singing synthesis output data corresponding to the edit target singing synthesis input data, a corresponding note by searching for the singing synthesis input data using the phonetic symbol that is correlated with the singing waveform data.

Figure 7:
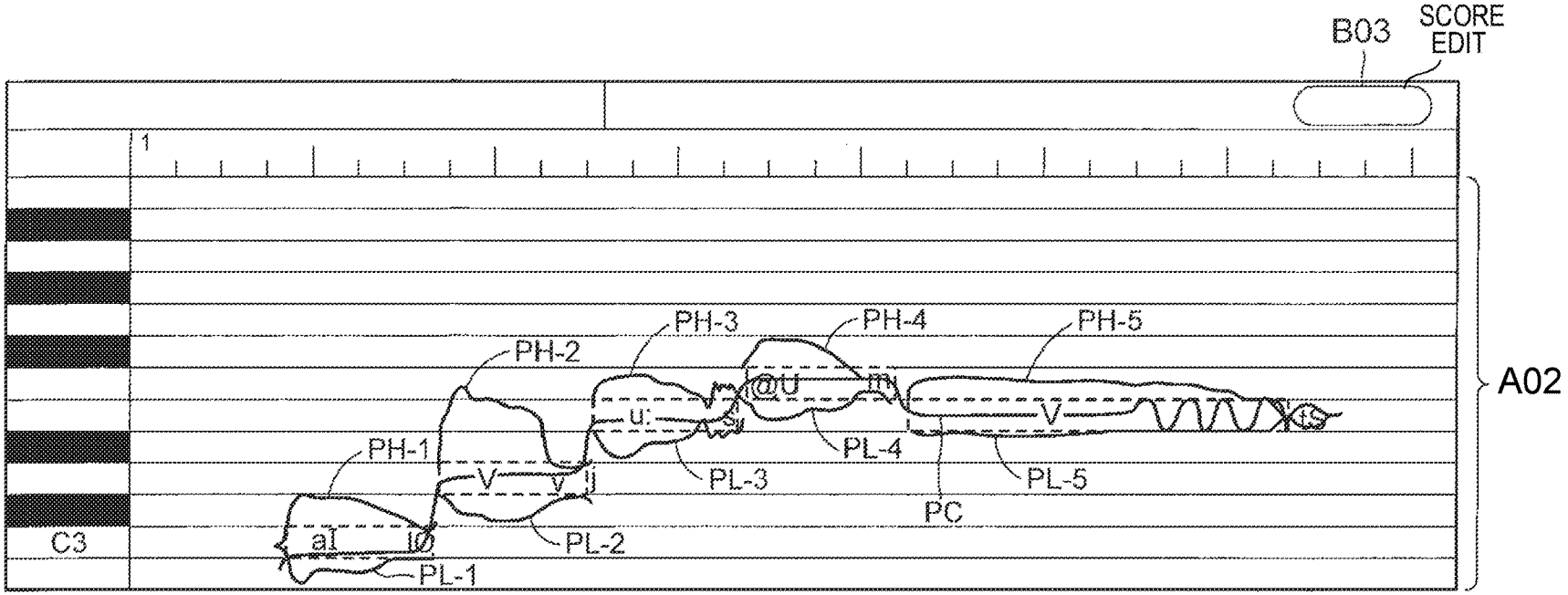
FIG. 7 shows an example waveform screen that the control unit 100 operating according to the edit assist program causes the display unit 120*a* to display (envelope form).

Then, as shown in FIG. 7, the control unit 100 determines, for an nth note (n=0, 1, 2, . . . ), an envelope PH-n of a positive peak (mountain) and an envelope PL-n of a negative peak (valley) of a waveform W-n corresponding to the note among the waveforms represented by the singing waveform data and draws the envelopes PH-n and PL-n at positions, corresponding to the pitch of the note, in the pitch axis direction in the edit area A02. The envelope PH-n represents a temporal variation of a mountain (positive maximum amplitude) of a singing voice waveform and the envelope PL-n represents a temporal variation of a valley (negative maximum amplitude) of the singing voice waveform. Thus, where the envelopes of each singing voice waveform are drawn, zero-value positions of the envelopes are set at a position (in the pitch axis direction) of the pitch of the note corresponding to the waveform.

Figure 8:
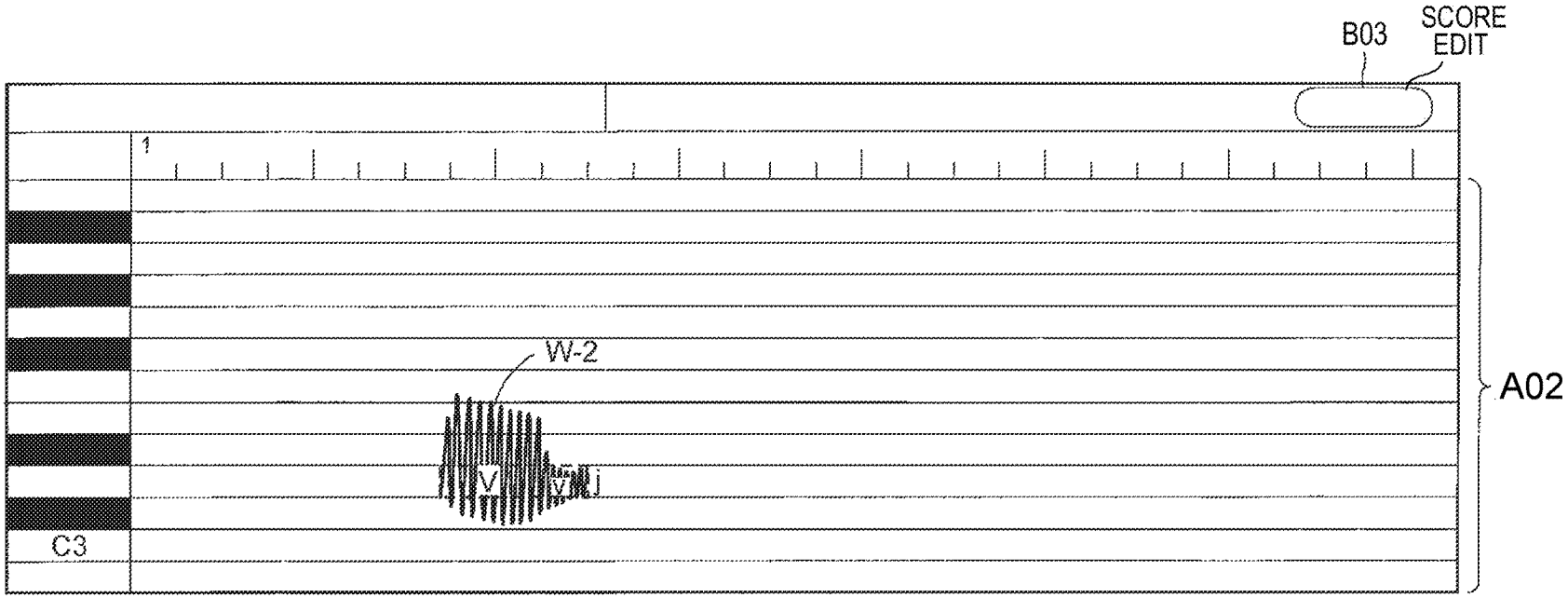
FIG. 8 shows another example waveform screen that the control unit 100 operating according to the edit assist program causes the display unit 120*a* to display (singing waveform form).

On the other hand, where the singing waveform form is employed, for an nth note (n=0, 1, 2, . . . ), the control unit 100 draws the waveform W-n at a position, in the pitch axis direction, of the pitch of the note in the edit area A02. A zero-value position of a singing voice waveform is set at a position, in the pitch axis direction, of the pitch of the note corresponding to the singing voice waveform. FIG. 8 shows an example display in the case where the singing waveform form is employed. In FIG. 8, to prevent the figure from becoming unduly complex, only the singing voice waveform W-2 corresponding to the second waveform in FIG. 7 is shown in FIG. 8. A measure may be taken so that the display form of singing voice waveforms employed at step SB100 can be switched according to a user instruction.

At a phoneme display step SB110 of the waveform display process, as shown in FIG. 7, the control unit 100 displays a phonetic symbol representing each of phonemes of words at a position, corresponding to a time point of the start of pronunciation of the phoneme, on the time axis in the edit area A02 according to the edit target singing synthesis input data. More specifically, the control unit 100 determines a time frame where switching occurs between phonetic symbols representing phonemes of words by referring to the singing synthesis output data corresponding to the edit target singing synthesis input data. Then the control unit 100 determines a time of this frame on the basis of where this frame is located in the series of time frames when counted from the head frame, employs this time as a time point to start pronouncing the phoneme represented by the phonetic symbol concerned, and converts this time point into a position on the time axis in the edit area A02. In this manner, the control unit 100 determines a display position of the phonetic symbol concerned on the time axis. On the other hand, it is appropriate to determine a display position in the pitch axis direction by determining a pitch at the thus-determined time point by referring to the edit target singing synthesis input data.

At a note display step SB120 of the waveform display process, the control unit 100 displays note blocks of respective notes in the edit area A02. On the waveform screen employed in the embodiment, as shown in FIG. 7, each note block is a rectangle having a broke-line outline. And note blocks are displayed on the waveform screen in the same manner as on the score edit screen.

At a pitch curve display step SB130 of the waveform display process, as shown in FIG. 7, the control unit 100 displays a pitch curve PC indicating a temporal variation of the pitch in the edit area A02 on the basis of pitch curve data contained in the singing synthesis output data. Although in the embodiment the pitch curve PC is displayed on the basis of the pitch curve data contained in the singing synthesis output data, it may be displayed on the basis of the pitch data contained in the singing synthesis input data.

For example, where the singing synthesis input data IND is designated as an edit target, the waveform display step SB100 to the pitch curve display step SB130 are executed on the basis of the singing synthesis output data OUTD which corresponds to the singing synthesis input data IND. As a result, the waveform screen shown in FIG. 7 is displayed on the display unit 120*a*.

As mentioned above, in an actual singing voice, there may occur a difference between the start timing of a note and the voice reproduction start timing of a word corresponding to the note. In this case, in the embodiment, the phonetic symbols representing the phoneme of this word are display at their true pronunciation position (pronunciation timing) on the basis of the singing synthesis output data OUTD so as to stick out of the rectangle indicating the note corresponding the word. In the example shown in FIG. 7, the head phoneme "lO" of the word "love," the head phoneme "s" of the word "so," and the head phoneme "m" of the word "much" are displayed earlier than the pronunciation timings of the notes corresponding to these words, respectively, that is, inside the note blocks of the notes immediately preceding the notes corresponding to these words, respectively.

As described above, in the singing synthesizer 1 according to the embodiment, when a difference exists between the start timing of a note and the voice reproduction start timing of a word corresponding to the note, the phonetic symbol of the head phoneme is displayed so as to stick out of the rectangle of the note corresponding to this word. As a result, the user of the singing synthesizer 1 can recognize visually that a difference exists between the start timing of the note and the voice reproduction start timing of the word corresponding to the note.

When visually recognizing the waveform screen shown in FIG. 7, the user can perform a manipulation of switching the display screen of the display unit 120*a* to the above-described score edit screen. As shown in FIG. 7, the waveform screen is provided with a score edit button B03 instead of the waveform display button B02. Alternatively, the waveform display button B02 and the score edit button B03 may be displayed side by side on the waveform screen. In this case, also on the score edit screen, the waveform display button B02 and the score edit button B03 may always be displayed side by side. That is, a mode is possible in which both of the waveform display button B02 and the score edit button B03 are always displayed.

The score edit button B03 is a virtual manipulator that allows a user to make an instruction to switch the display screen of the display unit 120*a* to the above-described score edit screen. The user can make an instruction to switch to the score edit screen by clicking the score edit button B03.

In a state that the waveform screen is displayed on the display unit 120*a*, the user can change, for each note, the start timing of the singing waveform corresponding to the note. For example, the user can designate a change target note by, for example, mouse-overing or tapping an attack portion of a singing waveform whose start timing is desired to be changed. In the embodiment, even if the start timing of a singing waveform corresponding to a note is changed, its end timing is not changed. That is, a change of the start timing of a singing waveform corresponding to a note does not mean a parallel movement of the entire singing waveform in the time axis direction. If the start timing of a singing waveform is changed to an earlier timing, the length of the entire singing waveform in the time axis direction is elongated accordingly. On the other hand, if the start timing of a singing waveform is delayed, the length of the entire singing waveform in the time axis direction is shortened accordingly.

Figure 9:
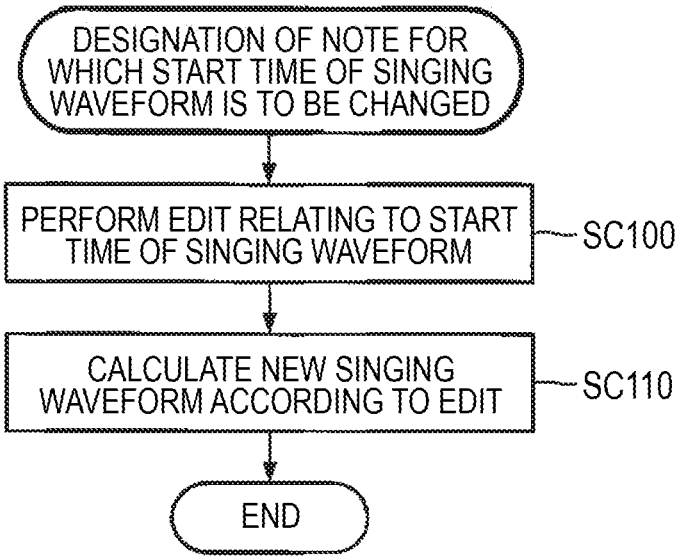
FIG. 9 is a flowchart of a change process which is executed by the control unit 100 according to the edit assist program.

When a note is designated the start timing of a singing waveform corresponding to which is to be changed, the control unit 100 operating according to the edit assist program executes a change program shown in FIG. 9. At step SC100 of the change program shown in FIG. 9, the control unit 100 receives an instruction to change the start timing of the singing waveform corresponding to the note and edits the start timing of the singing waveform according to the instruction.

Figure 10:
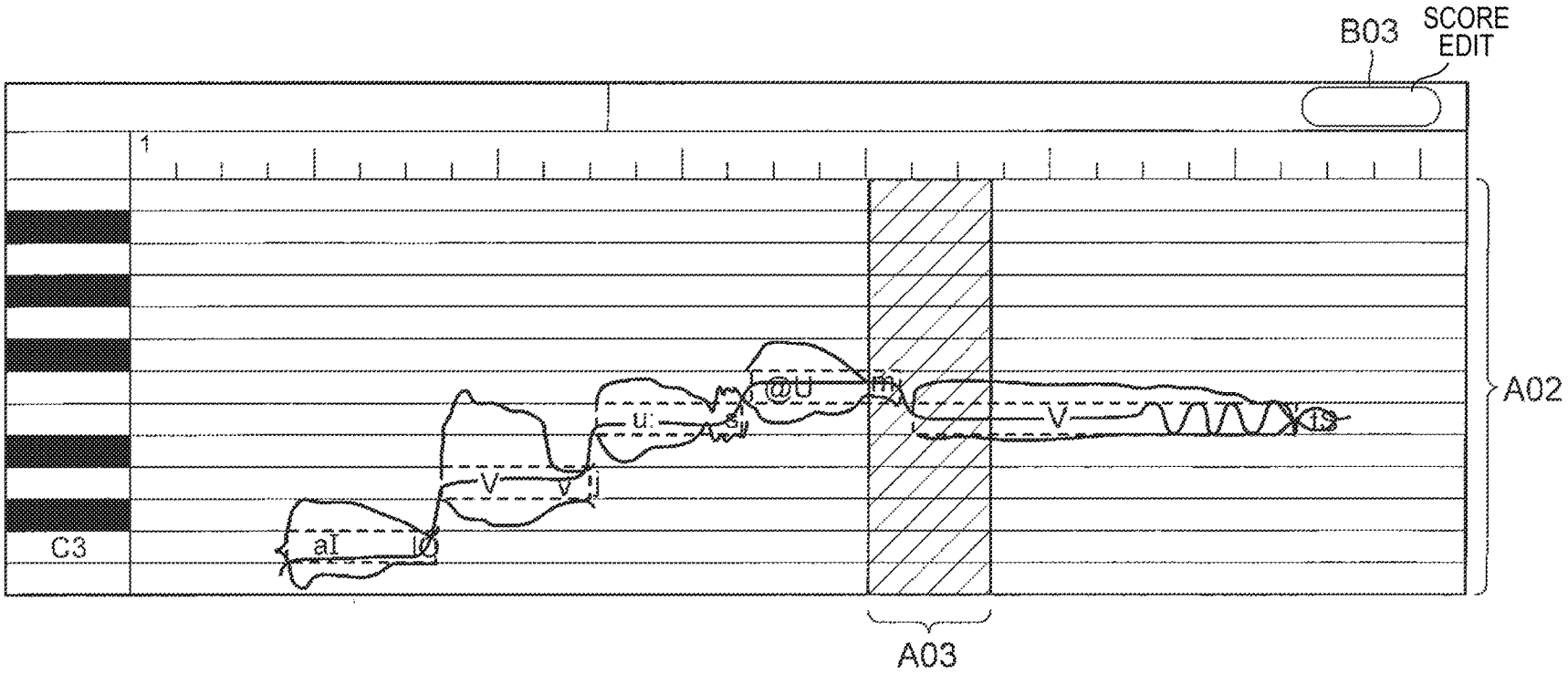
FIG. 10 shows an example manner of display, in the waveform screen, of an edit target region A03 indicating a start time of a singing waveform.

More specifically, the control unit 100 displays an attack portion (edit target region) of the singing waveform corresponding to the note designated by mouse-overing, for example. FIG. 10 shows, by hatching, an edit target region A03 in a case that the note corresponding to a word "much," that is, the fifth note, has been designated by mouse-overing, for example. FIG. 10 shows an example display of the case that the envelope form is employed as the display form of singing waveforms.

The start timing of the head phoneme of the word "much" is located in the immediately preceding note, that is, the fourth note, which is a phenomenon mentioned above. Thus, the start position of the edit target region A03 is located in the fourth note. The user can specify a movement direction and a movement distance of the start position of the singing waveform corresponding to the note designated by, for example, mouse-overing by dragging the start position of the edit target region A03 leftward or rightward with the mouse, for example.

At step SC110 shown in FIG. 9, the control unit 100 calculates singing waveform data again according to the details of the edit done at step SC100 (i.e., the movement direction and the movement distance, specified by the drag manipulation, of the start position of the edit target region A03) and changes the display of the waveform screen. As a result, the user can immediately recognize visually a variation of the singing waveform corresponding to the details of the edit done at step SC100.

More specifically, the control unit 100 changes, according to the variation of the start position of the edit target region A03, the value of a parameter that prescribes a consonant length and is included in parameters for adjustment of intrinsic singing features of the note designated by mouse-overing, for example. Even more specifically, if the start position of the edit target region A03 has been moved leftward, the control unit 100 changes data of the note concerned so that the consonant is made longer as the movement distance becomes longer. Conversely, if the start position of the edit target region A03 has been moved rightward, the control unit 100 changes the data of the note concerned so that the consonant is made shorter as the movement distance becomes longer.

The control unit 100 generates singing synthesis output data again on the basis of singing synthesis input data whose adjustment parameters relating to the intrinsic singing features have been changed in the above-described manner. At step SC110, as at the above-described step SA110, the control unit 100 generates, again, only singing waveform data corresponding to the note whose start position has been changed.

As described above, in the embodiment, when a difference exists between the start timing of a note and the voice reproduction start timing of a word corresponding to the note, the phonetic symbol of the head note of the word concerned is displayed outside the rectangle indicating the note corresponding to the word. As a result, the user of the singing synthesizer 1 can edit a singing voice while recognizing visually that a difference exists between the start timing of the note and the voice reproduction start timing of the word corresponding to the note, and hence can easily edit a voice reproduction start portion of the word corresponding to the note.

Figure 11:
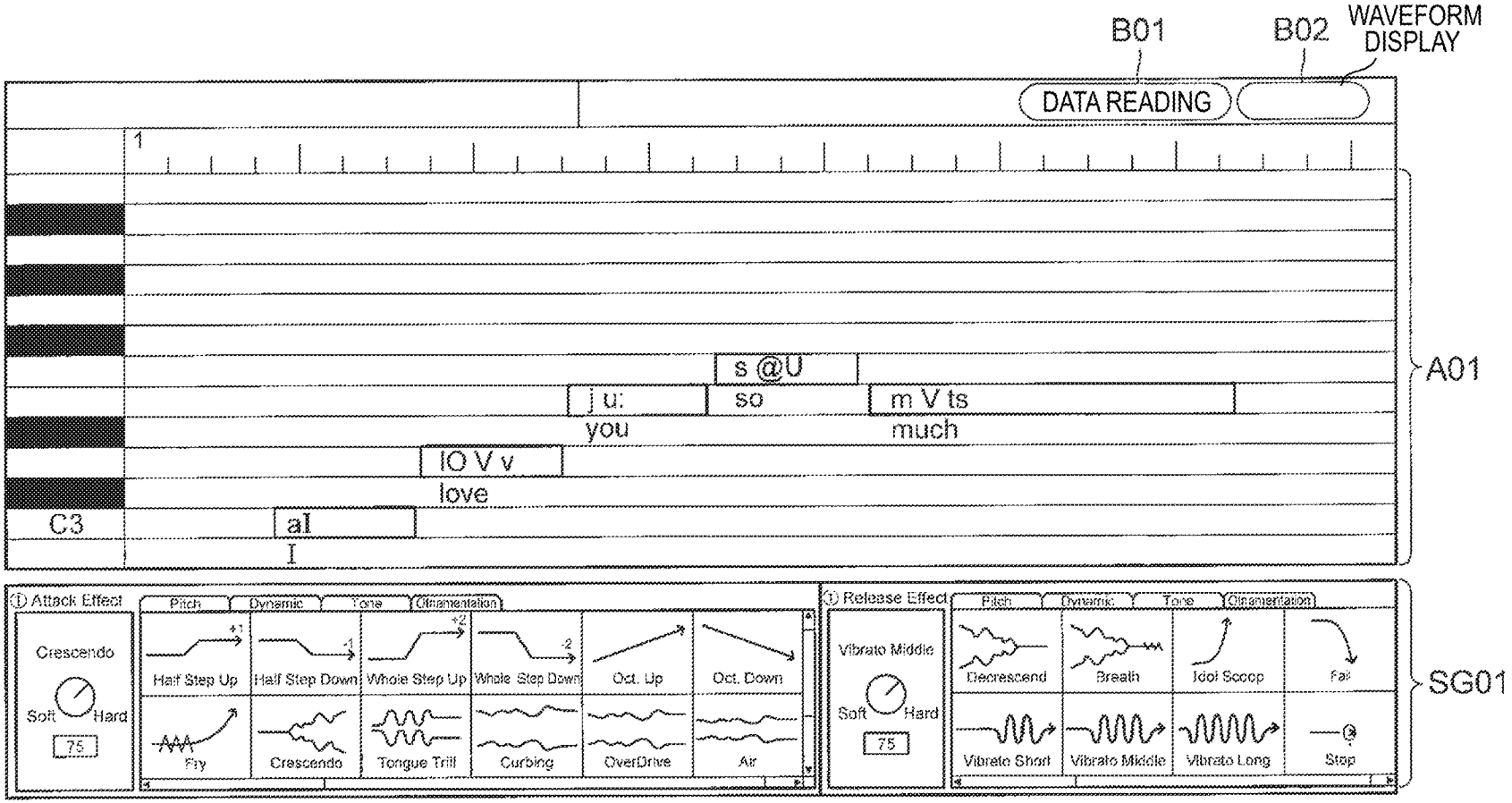
FIG. 11 shows an example auxiliary edit screen to be used in adding an effect to an attack portion or a release portion of a pitch curve.

Although the embodiment of the invention has been described above, the following modifications can naturally be made of the embodiment:

(1) As shown in FIG. 11, an auxiliary edit screen SG01 for allowing the user to select an effect to be added to an attack portion or a release portion of a pitch curve in editing a note or a word may be displayed on the display unit 120*a* so as to be adjacent to the score edit screen. This measure allows the user to select an effect to be added to an attack portion or a release portion of the pitch curve. This mode provides an advantage that an effect can be added easily to an attack portion or a release portion of the pitch curve.

A pitch curve editing step of receiving, for each note, an instruction to change an attack portion or a release portion of the pitch curve and editing the pitch curve according to the instruction may be provided in addition to or in place of the above-described start timing editing step.

(2) Although in the embodiment both of a pitch curve and note blocks are displayed on the waveform screen, only one of the pitch curve and the note blocks may be displayed on the waveform screen. This is because it is possible to recognize a temporal pitch variation on the waveform screen using only one of a display of the pitch curve and a display of the note blocks. Furthermore, since a temporal pitch variation can be recognized on the basis of singing waveforms, both of a display of the pitch curve and a display of the note blocks may be omitted. That is, one or both of the note display step SB120 and the pitch curve display step SB130 shown in FIG. 6 may be omitted.

(3) Although in the embodiment various screens such as the score edit screen and the waveform screen are displayed on the display unit 120*a* of the singing synthesizer 1, these screens may be displayed on a display device that is connected to the singing synthesizer 1 via the external device I/F unit 110. Likewise, instead of using the manipulation unit 120*b* of the singing synthesizer 1, a mouse and a keyboard that are connected to the singing synthesizer 1 via the external device I/F unit 110 may serve as a manipulation input device for inputting various instructions to the singing synthesizer 1.

Furthermore, although in the embodiment the control unit 100 of the singing synthesizer 1 performs the edit assistant method according to the invention, an edit assistant device that performs the edit assistant method may be provided as a device that is separate from a singing synthesizer.

Figure 12:
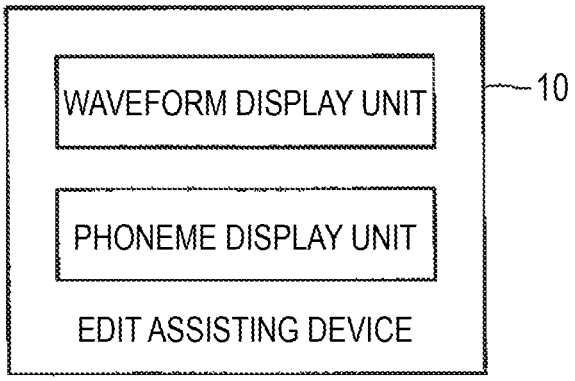
FIG. 12 shows an example configuration of an edit assistant device 10 according to the invention.

More specifically, as shown in FIG. 12, an edit assistant device 10 may be provided which is a combination of a waveform display unit and a phoneme display unit. The waveform display unit is a unit for executing the waveform display step SB100 shown in FIG. 6, and the phoneme display unit is a unit for executing the phoneme display step SB110 shown in FIG. 6.

A program for causing a computer to function as the above waveform display unit and the phoneme display unit may be provided. This mode makes it possible to use a common computer such as a personal computer or a tablet terminal as the edit assistant device according to the invention.

Furthermore, a cloud mode is possible in which the edit assistant device is implemented by plural computers that can cooperate with each other by communicating with each other over a communication network, instead of a single computer. More specifically, in this mode, the waveform display unit and the phoneme display unit are implemented by separate computers.

What is claimed is:

1. A singing voice edit assistant method comprising:

displaying singing waveforms represented by singing waveform data calculated based on score data representing a time series of notes and lyrics data representing words on a display device, on a note-by-note basis on a two-dimensional waveform screen having a pitch axis and a time axis, each singing waveform being displayed at a position located by a pitch and timing of a note corresponding to the singing waveform; and displaying a phoneme of each word at a pronunciation timing of the phoneme on the waveform screen.

2. The edit assistant method according to claim 1, further comprising:

switching the display screen of the display device to a score edit screen for editing of at least one of the score data and the lyrics data, in response to input of an instruction to edit at least one of the score data and the lyrics data; and changing at least one of the score data and the lyrics data according to an edit manipulation on the score edit screen, and calculating singing waveform data based on the changed score data or lyrics data.

3. The edit assistant method according to claim 1, further comprising:

receiving, for each note, an instruction to change a start timing of a singing waveform, and editing the start timing of the singing waveform according to the instruction; and calculating singing waveform data based on the edited start timing.

4. The edit assistant method according to claim 3, further comprising:

displaying note blocks indicating the respective notes in the form of individual figures based on the score data on a note-by-note basis on the waveform screen.

5. The edit assistant method according to claim 1, further comprising:

displaying a pitch curve indicating a temporal variation of the pitch on the waveform screen based on the score data;

receiving, for each note, an instruction to change an attack portion or a release portion of the pitch curve, and editing the pitch curve according to the instruction; and calculating singing waveform data based on the edited pitch curve.

6. The edit assistant method according to claim 5, wherein in the editing of the pitch curve, an auxiliary edit screen for prompting a user to expand or contrast the pitch curve in one of a time axis direction and a pitch axis direction according to a kind of an acoustic effect to be added to a singing voice is displayed by the display device, and the pitch curve is edited according to an instruction performed on the auxiliary edit screen.

7. A singing voice edit assistant device comprising:

a memory that stores instructions, and a processor that executes the instructions, wherein the instructions cause the processor to:

display singing waveforms represented by singing waveform data calculated based on score data representing a time series of notes and lyrics data representing words on a display device, on a note-by-note basis on a two-dimensional waveform screen having a pitch axis and a time axis, each singing waveform being displayed at a position located by a pitch and timing of a note corresponding to the singing waveform; and display a phoneme of each word at a pronunciation timing of the phoneme on the waveform screen.

8. The edit assistant device according to claim 7, wherein the instructions cause the processor to:

switch the display screen of the display device to a score edit screen for editing of at least one of the score data and the lyrics data, in response to input of an instruction to edit at least one of the score data and the lyrics data; and chance at least one of the score data and the lyrics data according to an edit manipulation on the score edit screen, and calculate singing waveform data based on the changed score data or lyrics data.

9. The edit assistant device according to claim 7, wherein the instructions cause the processor to:

receive, for each note, an instruction to change a start timing of a singing waveform, and edit the start timing of the singing waveform according to the instruction; and calculate singing waveform data based on the start timing.

10. The edit assistant device according to claim 9, wherein the instructions cause the processor to:

display note blocks indicating the respective notes in the form of individual figures based on the score data on a note-by-note basis on the waveform screen.

11. The edit assistant device according to claim 7, wherein the instructions cause the processor to:

display a pitch curve indicating a temporal variation of the pitch on the waveform screen based on the score data;

receive, for each note, an instruction to change an attack portion or a release portion of the pitch curve, and edit the pitch curve according to the instruction; and calculate singing waveform data based on the edited pitch curve.

12. The edit assistant device according to claim 11, wherein in the editing of the pitch curve, an auxiliary edit screen for prompting a user to expand or contrast the pitch curve in one of a time axis direction and a pitch axis direction according to a kind of an acoustic effect to be added to a singing voice is displayed by the display device, and the pitch curve is edited according to an instruction performed on the auxiliary edit screen.

13. The edit assistant device according to claim 7, wherein the instructions cause the processor to display the phoneme of each word at a pitch and the pronunciation timing of the phoneme on the waveform screen.

14. The edit assistant method according to claim 1, wherein the displaying comprises displaying the phoneme of each word at a pitch and the pronunciation timing of the phoneme on the waveform screen.

* * * * *